United States Patent [19]

Herold et al.

[11] Patent Number: 5,003,881

[45] Date of Patent: Apr. 2, 1991

[54] AERIAL FLARE AND IGNITER

[75] Inventors: Stanley J. Herold, Switz City; Charles D. Howard, Edwardsport; Donald E. LaGrange, Washington, all of Ind.

[73] Assignee: The United States of America as represented by the Secretary of the Navy, Washington, D.C.

[21] Appl. No.: 564,234

[22] Filed: Aug. 7, 1990

[51] Int. Cl.[5] ..... F42B 4/28; F42C 15/24; F42C 15/26

[52] U.S. Cl. ..... 102/337; 102/340; 102/234; 102/253

[58] Field of Search ..... 102/234, 231, 252, 253, 102/247, 337, 339, 340, 348, 356

[56] References Cited

U.S. PATENT DOCUMENTS

| | | | |
|---|---|---|---|
| 2,625,881 | 1/1953 | Rabinow | 102/251 |
| 2,873,677 | 2/1959 | Taylor et al. | 102/234 |
| 2,925,778 | 2/1960 | Von Nemeth | 102/251 |
| 3,038,407 | 6/1962 | Robertson et al. | 102/340 |
| 3,382,803 | 5/1968 | Swallow et al. | 102/254 |
| 3,631,728 | 1/1972 | Pracher et al. | 102/253 |
| 3,638,501 | 2/1972 | Pracher | 102/253 |
| 3,715,668 | 2/1973 | Herring et al. | 102/339 |
| 3,722,419 | 3/1973 | James | 102/251 |
| 4,896,607 | 1/1990 | Hall et al. | 102/247 |

*Primary Examiner*—David H. Brown
*Attorney, Agent, or Firm*—William C. Townsend; Edward J. Connors, Jr.

[57] ABSTRACT

Illuminating flare has an igniter in which a two-part inertial mass is guided for relative aftward movement from a safe position to an armed position under launching forces. One part of the mass undergoes relative forward movement to an ignition position under parachute-opening, deceleration forces while the other part of the mass is restrained from moving as far forward as the first part. This separation of the parts of the mass releases locking balls to unlock a firing pin, which stabs a primer and initiates ignition of the flare. The primer is contained in a rotor, and as the mass traverses from the safe position to the armed position it rotates and the rotor rotates with the mass. In the safe position the primer is out of communication with an ignition passage through which ignition of the illuminant composition occurs. Rotation of the rotor as the mass traverses to the armed position places the primer in communication with the ignition passage where it remains until activated by the firing pin.

8 Claims, 4 Drawing Sheets

AERIAL FLARE AND IGNITER

BACKGROUND OF THE INVENTION

Aerial flares are used for night illumination for search and rescue operations, signaling and other purposes. One type of flare presently in use is disadvantageous in that it has neither as much burn time, nor as long a range from the launch location, as might be desired. One limitation on burn time is the need to provide a raceway through the ignitable illuminant composition for an ignition lanyard to reach from an igniter located at the forward end of the flare to be pulled by deployment of a parachute at the aft end of the flare. Thus, space which could otherwise be filled with additional flare composition for increased burn time must be devoted to the lanyard raceway.

A limitation on the launching range of the current flares is imposed by blunt noses on the igniters. Blunt noses are aerodynamically inefficient, and thus limit the distance over which the flares can travel from the launcher.

Accordingly, main objects of the invention are the provision of improved igniters and aerial flares which overcome the difficulties associated with the prior art.

Other objects of the invention are to provide improved aerial flares having increased burn time, and igniters that are self-contained, requiring no raceway through the charge composition.

Still other objects of the invention are the provision of improved aerial flares that have a longer range from the launching site, and igniters configured to enable same.

Other objects and advantages of the invention will appear from the following detailed description which, together with the accompanying drawings, discloses a preferred embodiment of the invention for purposes of illustration only. For definition of the invention, reference will be made to the appended claims.

DETAILED DESCRIPTION OF THE PREFERRED EMBODIMENT

Figure 1:
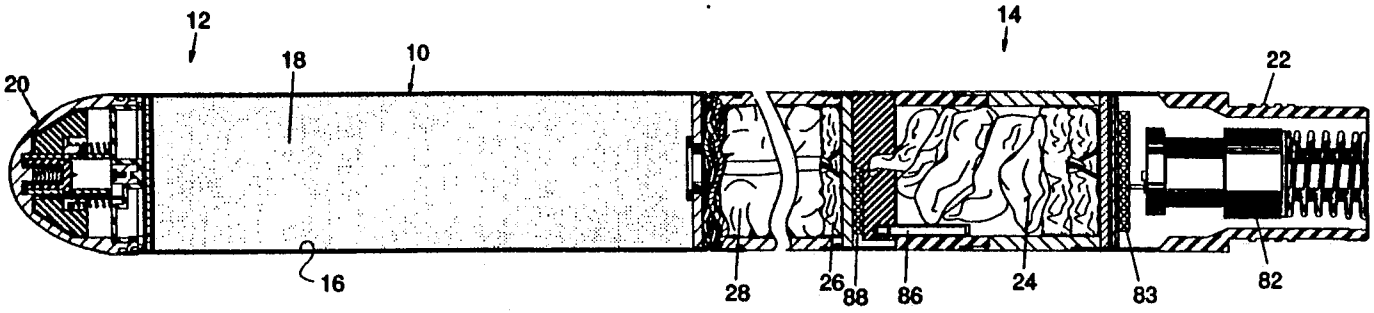
FIG. 1 is a longitudinal cross-sectional view of a flare embodying principles of the invention.

The aerial flare of FIG. 1 comprises a housing 10 containing the various components of the flare and having fore and aft portions 12, 14 respectively. The interior walls of housing 10 define a series of compartments, and a charge of ignitable illuminant composition 18 is disposed in compartment 16. Illuminant 18 may be of any suitable, conventional type and may for example comprise about 62% magnesium, 33% sodium nitrate, and the balance essentially a polymeric binder.

Figure 2:
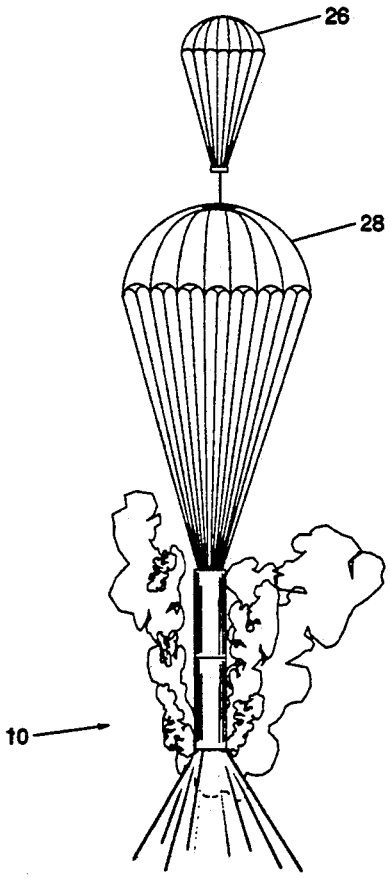
FIG. 2 illustrates the operation of the flare of FIG. 1.

A self-contained igniter 20 is disposed at the fore end portion of housing 10. At the extreme aft end of the housing are threads 22 for attaching the flare to a conventional rocket motor (not shown) for launching from a site on land, a surface vessel, or an aircraft. The housing also contains drogue parachute 24, pilot parachute 26, and main parachute 28, for decelerating and retarding descent of the launched flare. Operation is initiated by launching in a conventional manner which imparts forward movement as well as rotational, spin-stabilizing motion to the flare as it begins its flight trajectory. After a sequence of operations to be described in detail below, the parachutes are deployed and the illuminant ignited, and the flare slowly descends to the surface of the earth while providing the desired illumination as shown in FIG. 2.

Figure 3A:
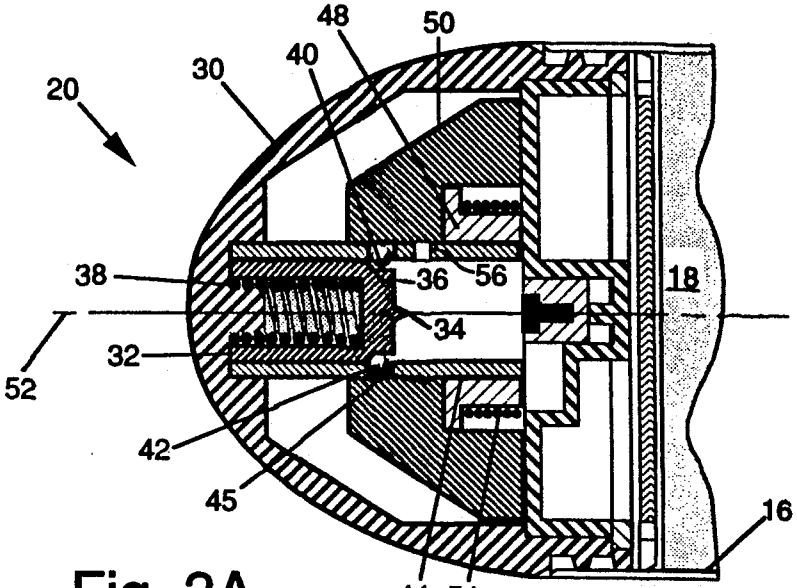
FIGS. 3A and 3B show the same parts in the armed and ignition positions, respectively.
Figure 3:
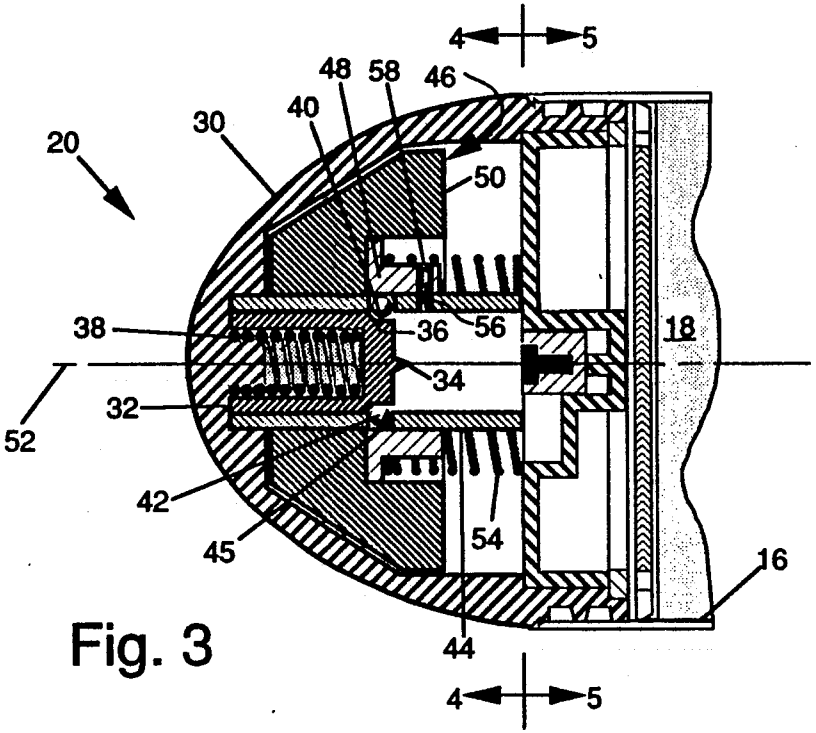
FIG. 3 is a longitudinal cross-sectional view of the igniter of the flare of FIG. 1, showing the parts in the safe position.
Figure 4:
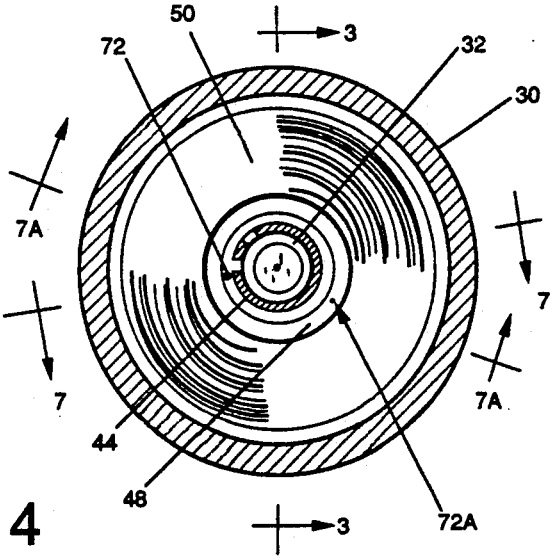
FIG. 4 is a cross-sectional view taken on line 4—4 of FIG. 3.

Igniter 20 comprises an ogive nose portion 30 (FIG. 3) that forms a part of the flare housing and contains the operating components of the igniter. Igniter 20 includes a hollow, cylindrical firing pin 32 (see also FIG. 4) for initiating ignition of the flare. Firing pin 32 has a primer-stabbing point 34 and a recessed shoulder portion 36, and is biased in an aft direction by firing pin spring 38. Spring 38 is compressed in FIG. 3, the igniter parts being in the safe position for shipment, storage, and launching of the flare. The firing pin is locked in position against the energy of compressed spring 38 from initiating ignition of the flare by a pair of diametrically opposed locking balls 40, 42 which engage recessed shoulder 36. Upon release of the locking balls in a manner to be described, spring 38 powers the firing pin aft to initiate ignition of the flare. The pin is guided in its aftward, powered movement by cylindrical firing pin housing 44, which is fixed to nose portion 30. Each locking ball is received in a circular aperture, as 45, in firing pin housing 44 as shown in FIG. 3, and each aperture has a diameter that is slightly larger than that of the ball that it receives.

Igniter 30 also comprises a generally toroidal, two-part, inertial mass 46 that comprises rotor setback 48 and rotor setback weight 50 that is separable from setback 48. When the igniter parts are in the safe position as shown in FIG. 3, the interior walls of setback 48 hold the locking balls confined in the apertures in firing pin housing 44, to lock the firing pin. Firing pin housing 44 mounts inertial mass 46 for movement relative to the housing along fore-and-aft axis 52 from the safe position shown in FIG. 3 to an armed position that is aft of the safe position and is shown in FIG. 3A. This relative movement is imparted by launching forces, which propel the flare forwardly and thus cause mass 46, because of its own inertia and slidable mounting on firing pin housing 44, to lag in forward movement and accordingly move aftward relative to the housing as the flare unit begins its flight trajectory. Mass 46 is biased in the safe position by rotor setback spring 54, which is compressed by the mass as it undergoes relative movement to the armed position. Throughout the relative movement of mass 46 from the safe position to the armed position, the interior walls of setback 48 and then weight 50 continue to hold the locking balls in their apertures in the firing pin housing, so that the firing pin remains locked.

Figure 3B:
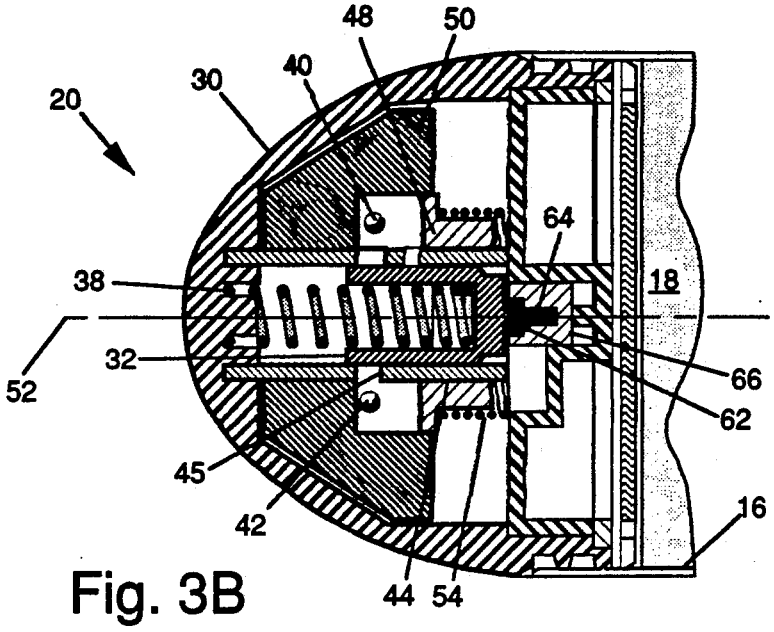
Figure 6:
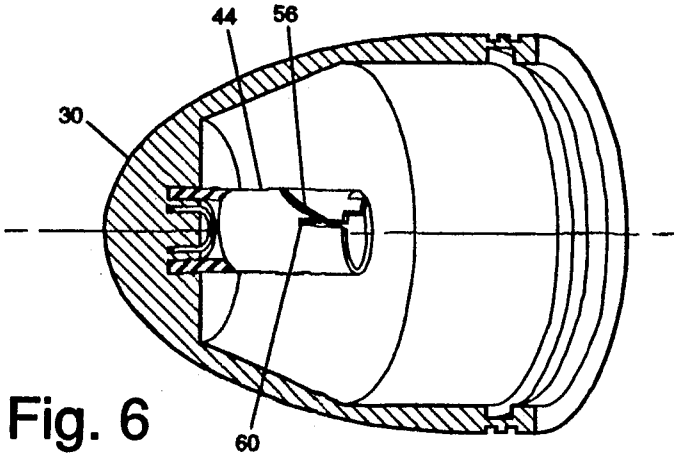
FIG. 6 is a perspective view, partly in cross-section, of details of the igniter of FIG. 3.

Spiral groove 56 (see also FIG. 6) is formed in firing pin housing 44 and projecting pin 58 is fixed on setback 48 to follow or ride in the groove so that, as mass 46 undergoes relative aftward movement from the safe position to the armed position, it also undergoes rotation relative to the housing about fore-and-aft axis 52. This action results from the forward-propulsion forces imparted to the flare on launch, and is promoted by the rotational, spin-stabilizing launching forces. In addition to guiding inertial mass 46 from the safe position shown in FIG. 3 to the armed position shown in FIG. 3A, firing pin housing 44 also guides weight 50 to an ignition position that is forward of the armed position and is shown in FIG. 3B. This occurs upon application of parachute opening forces, often termed snatch forces, which decelerate the flare. Because of the inertia of weight 50 and its slidable mounting, the weight tends to lag in deceleration, resulting in relative forward movement of the weight with respect to the housing, to the ignition position of FIG. 3B. Setback 48, however, is restrained from moving with weight 50 to the ignition position of the weight by engagement of follower pin 58 with the forward end wall of a detent slot 60 (see FIG. 6) that is formed in firing pin housing 44 and extends in a direction along the fore-and-aft axis a distance less than spiral groove 56. Detent slot 60 communicates with the aft end portion of groove 56 so that follower 58 enters the slot upon aftward movement of mass 46 to the armed position, but when the axially-directed inertial forces resulting from parachute deployment tend to move the mass relatively forwardly, follower 58 moves axially forwardly in the detent slot to engage its forward end wall, thus restraining setback 48 from further relative forward movement with weight 50. Since weight 50 is separable from setback 48, the weight continues under inertial forces to slide to the ignition position shown in FIG. 3B.

The interior walls of weight 50 continue to confine locking balls 40, 42 in their apertures in firing pin housing 44 until the weight reaches the ignition position. At that time, however, the weight uncovers the apertures, thereby releasing the balls from confinement. The energy in compressed firing pin spring 38 is thus released to power the firing pin to eject the balls radially outwardly from the apertures. Thus unlocked, the pin is powered aftwardly by the spring to stab percussion primer 62 to initiate ignition of illuminant 18.

Figure 7:
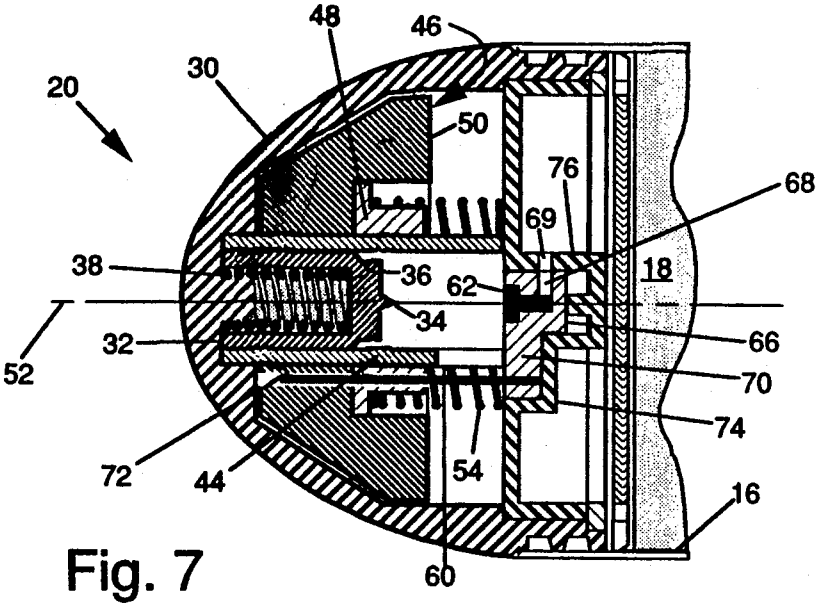
FIG. 7 is a another, longitudinal cross-sectional view of the igniter, taken on line 7—7 of FIG. 4 and showing additional parts in the safe position.

Primer 62 is disposed in a confined cavity 64 that is formed in primer rotor 66, and is open on the side facing firing pin 32. Ignition port 68 (see also FIG. 7) formed in rotor 66 communicates with cavity 64. Rotor 66 has eccentric portion 70, best shown in FIGS. 5 and 7, which fixedly carries a guide pin 72 that extends forwardly and is slidably received in aligned apertures in setback 48 and weight 50. Pin 72 thus operatively connects rotor 66 with mass 46 for rotation of rotor 66 with the rotational movement of mass 46 as it traverses axially aftwardly from the safe position to the armed position. As mass 46 rotates, guide pin 72 rotates or swings to point 72A in FIG. 4.

Figure 5:
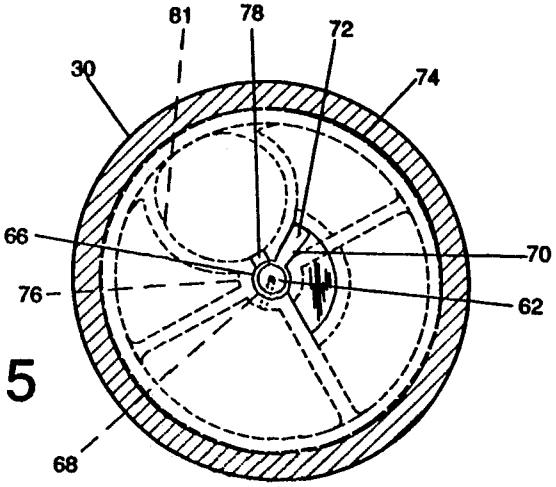
FIG. 5 is a cross-sectional view taken on line 5—5 of FIG. 3, showing the parts in the safe position.
Figure 5A:
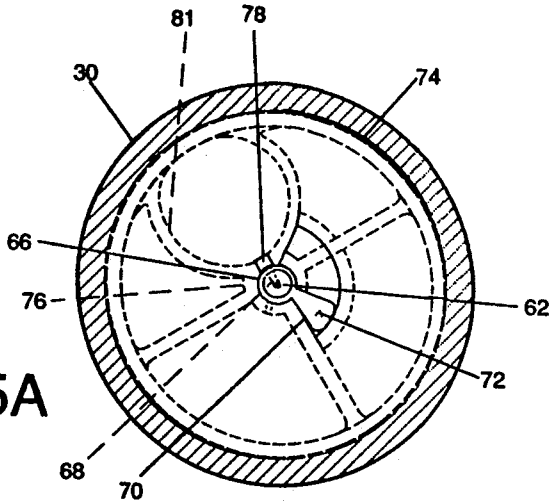
FIG. 5A shows the same parts in the armed and ignition positions.
Figure 7A:
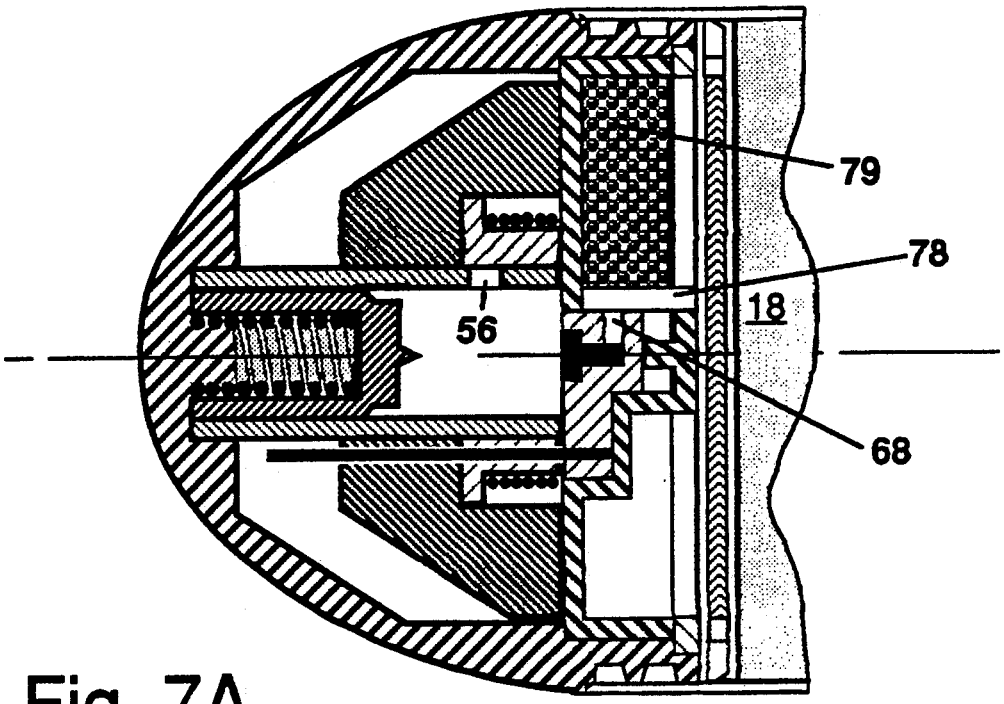
FIG. 7A shows the parts in the armed position, and is taken on line 7A—7A of FIG. 4. Note that section line 7A—7A is rotated from section line 7—7.
Figure 7B:
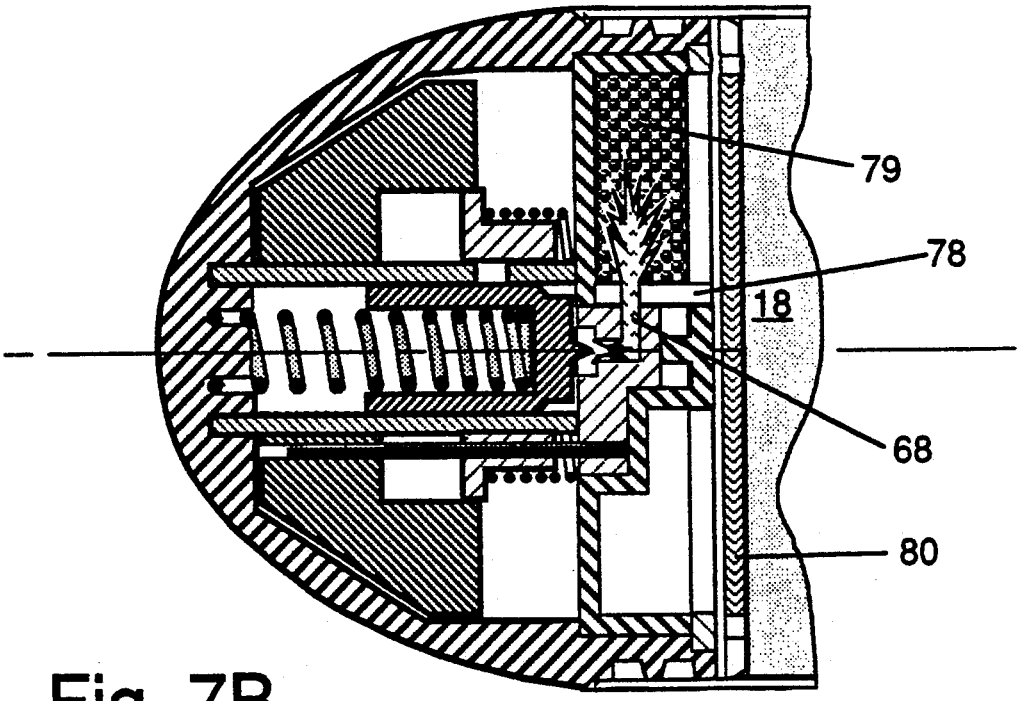
FIG. 7B shows the same parts as FIG. 7A, in the ignition position.

Rotor 66 is carried by a rotor mount 74, also termed an ignition cup, that mounts rotor 66 including eccentric 70 for rotation in an arc (see FIGS. 5 and 5A). Rotor mount 74 has generally cylindrical walls 76 that abut rotor 66, and an ignition passage or slot 78 is formed through walls 76 (see also FIG. 7A). Rotor 66 is mounted for rotation between a first position in which ignition port 68 is out of communication with ignition slot 78 (FIGS. 5, 7) when inertial mass 46 is in the safe position, and a second position in which ignition port 68 communicates with ignition slot 78 (FIGS. 5A, 7A) when the mass is in the armed position. Thus, the walls of rotor mount 74 open and close communication between the primer and the ignition slot as the rotor swings through its arc. In the safe position, accidental ignition of primer 62 is of minimal consequence because it is vented through safety passage 69 (FIG. 7) to a void cell in rotor mount 74. In the armed and ignition positions (FIGS. 7A and 7B, respectively) ignition of primer 62 initiates an explosive combustion sequence in which the primer, acting through ignition port 68 and ignition slot 78, ignites a plurality of conventional boron-potassium nitrate pellets 79. Pellets 79 are confined in a circular cell 81 (see also FIGS. 5, 5A) that is open on the side facing illuminant 18, and in turn ignite a conventional ammonium perchlorate-aluminum wafer 80, which ignites illuminant 18. It will be understood that, as is conventional, the ignition sequence generates a series of progressively increasing combustion temperatures as the series of components in the ignition train ignites, until finally the ignition temperature of illuminant 18 is attained. It will further be appreciated that the number and character of the components of the ignition train may be varied as desired to suit particular applications.

Returning to FIG. 1, the features aft of illuminant compartment 16 are conventional, and include delay fuze 82 located at the aft end of the flare. On burnout of the rocket motor, fuze 82 is activated by removal of the G-forces that had been applied by the rocket. Fuze 82 then fires a first expulsion charge 83 to separate the rocket motor and the aft end of the flare, the location of severance being that of expulsion charge 83. This action uncovers a disc to which drogue parachute 24 is attached, and the disc catches in the airstream and deploys the drogue parachute. Deployment of drogue parachute 84 applies decelerating forces to the flare, and also initiates another delay 86. As will be described later, the parachute-opening, snatch forces applied by deployment of the drogue parachute generate action in the igniter at the forward end of the flare.

After a two-second period to allow for sufficient deceleration of the flare for main parachute 28 to be opened without damage, delay 86 fires a second expulsion charge 88 which severs the flare housing at the location of charge 88, again cutting off the aft end of the flare. This action uncovers a disc to which pilot parachute 26 is attached, and the disc catches in the airstream and deploys the pilot parachute which pulls main parachute 28 from the housing for deployment and slow descent of the flare as shown in FIG. 2.

A summary of operation of the unit is as follows. Launching of the flare imparts forward and spin-stabilizing forces and motion to the unit. Because of the inertia of mass 46, it lags the remainder of the unit and undergoes relative axial and rotational movement from the safe position of FIGS. 3 and 7 to the armed position of FIGS. 3A and 7A, primer rotor 66 rotating with the mass so that ignition port 68 is moved into communication with ignition slot 78. Snatch forces applied by deployment of the drogue parachute decelerate the flare, but again by operation of inertial forces, weight 50 lags in deceleration and undergoes relative forward movement to the ignition position of FIGS. 3B and 7B. Setback 48, however, is restrained by engagement in the detent slot, so that weight 50 uncovers locking balls 40, 42 for ejection to release firing pin 32 for powered, aftward movement to stab primer 62 to initiate the ignition train.

It will be appreciated that the self-containment feature of the igniter according to the invention dispenses with need for a lanyard raceway through the illuminant compartment, thereby enabling more illuminant to be packed and thus extend the burn time of the flare. It will further be appreciated that the ogive nose configuration of the igniter provides improved aerodynamic efficiency, thereby increasing the launching range of the flare. However, the above description of the invention in connection with a preferred embodiment is not to be taken as limiting the principles of the invention as defined by the appended claims.

We claim:

1. An igniter, comprising actuating means for initiating ignition, locking means for holding the actuating means from initiating ignition, inertial mass means, guide means mounting the inertial mass means for relative movement along a fore-and-aft axis between a safe position and an armed position aft of the safe position under launching forces, the inertial mass means including setback means for holding the locking means in the safe position, the inertial mass means also including weight means separable from the setback means for holding the locking means in the armed position, means biasing the inertial mass means in the safe position, the guide means including means for guiding the weight means for relative movement to an ignition position forward of the armed position upon application of forward motion retarding forces, and retention means for restraining the setback means from movement to the ignition position with the weight means, the weight means including means for releasing the locking means upon movement of the weight means to the ignition position, thereby enabling the actuating means to initiate ignition.

2. The igniter of claim 1, in which the guide means includes means defining a spiral guide having an aft end portion, the inertial mass means includes follower means operatively engaging the spiral guide for relative rotational movement about the fore-and-aft axis under launching forces, and the retention means includes detent means operatively associated with the aft end portion of the spiral guide and extending in a fore-and-aft direction a distance less than the spiral guide for engaging the follower means to restrain the setback means from movement to the ignition position with the weight means.

3. The igniter of claim 1, including rotor means including means defining a confined cavity and means defining an ignition port communicating with the cavity, ignition primer means disposed in the cavity and aligned for activation by the actuating means, wall means abutting the rotor means and including means defining an ignition passage through the wall means, the guide means including means mounting the inertial mass means for relative rotational movement about the fore-and-aft axis under launching forces, means operatively connecting the rotor means with the inertial mass means for rotation of the rotor means with the rotational movement of the inertial mass means, and means mounting the rotor means for rotation between a first position in which the ignition port is out of communication with the ignition passage when the inertial mass means is in the safe position, and a second position in which the ignition port communicates with the ignition passage when the inertial mass means is in the armed position.

4. An aerial flare, comprising a housing having fore and aft portions, parachute means carried by the aft portion of the housing, self-contained igniter means disposed at the fore portion of the housing, the igniter means including actuating means for initiating ignition of the flare, locking means for holding the actuating means from initiating ignition, inertial mass means, guide means mounting the inertial mass means for movement relative to the housing along a fore-and-aft axis between a safe position and an armed position aft of the safe position under launching forces, the inertial mass means including setback means for holding the locking means in the safe position, the inertial mass means also including weight means separable from the setback means for holding the locking means in the armed position, and means biasing the inertial mass means in the safe position, and means for deploying the parachute means, the guide means including means for guiding the weight means for movement relative to the housing to an ignition position forward of the armed position upon application of parachute opening forces, the igniter means including retention means for restraining the setback means from movement to the ignition position with the weight means, the weight means including means for releasing the locking means upon movement of the weight means to the ignition position, thereby enabling the actuating means to initiate ignition.

5. The flare of claim 4, in which the guide means includes means defining a spiral guide having an aft end portion, the inertial mass means includes follower means operatively engaging the spiral guide for rotational movement relative to the housing about the fore-and-aft axis under launching forces, and the retention means includes detent means operatively associated with the aft end portion of the spiral guide and extending in a fore-and-aft direction a distance less than the spiral guide for engaging the follower means to restrain the setback means from movement to the ignition position with the weight means.

6. The flare of claim 5, in which the spiral guide includes a means defining a groove fixed in position relative to the housing, the follower means includes a projecting member carried by the setback means and riding in the groove, and the detent means includes means defining a slot communicating with the groove for engaging and restraining the projecting member upon movement of the weight means to the ignition position.

7. The flare of claim 4, including rotor means including means defining a confined cavity and means defining an ignition port communicating with the cavity, ignition primer means disposed in the cavity and aligned for activation by the actuating means, wall means abutting the rotor means and including means defining an ignition passage through the wall means, the guide means including means mounting the inertial mass means for relative rotational movement about the fore-and-aft axis under launching forces, means operatively connecting the rotor means with the inertial mass means for rotation of the rotor means with the rotational movement of the inertial mass means, and means mounting the rotor for rotation between a first position in which the ignition port is out of communication with the ignition passage when the inertial mass means is in the safe position, and a second position in which the ignition port communicates with ignition passage when the inertial mass means is in the armed position.

8. An aerial flare, comprising a housing having fore and aft portions, parachute means carried by the aft portion of the housing, self-contained igniter means disposed at the fore portion of the housing, the igniter means having an ogive nose portion and including actuating means for initiating ignition of the flare, the actuating means including a firing pin having a shoulder portion and spring means for powering the firing pin, locking means for holding the actuating means from initiating ignition, the locking means including at least one ball member engaging the shoulder portion of the firing pin, inertial mass means, guide means mounting the inertial mass means for movement relative to the housing along a fore-and-aft axis between a safe position and an armed position aft of the safe position under launching forces, the guide means including means defining a spiral groove having an aft end portion, the inertial mass means having follower means including a projecting member riding in the spiral groove for rotational movement relative to the housing about the fore-and-aft axis under launching forces, the guide means also mounting the firing pin for movement along the fore-and-aft axis and including means defining an aperture receiving the ball member, the inertial mass means including setback means for holding the ball member in the aperture in the safe position, the projecting member being carried by the setback means, the inertial mass means also including weight means separable from the setback means for holding the ball member in the aperture in the armed position, and means biasing the inertial mass means in the safe position, means for deploying the parachute means, the guide means including means for guiding the weight means for movement relative to the housing to an ignition position forward of the armed position upon application of parachute opening forces, the igniter means including retention means for restraining the setback means from movement to the ignition position with the weight means, the retention means including detent means defining a slot communicating with the aft end portion of the spiral groove and extending in a fore-and-aft direction a distance less than the spiral groove for engaging the projecting member to restrain the setback means from movement to the ignition position with the weight means, means defining a compartment in the housing, and an ignitable illuminant disposed in the compartment, the igniter means including rotor means including means defining a confined cavity and means defining an ignition port communicating with the cavity, ignition primer means disposed in the cavity and aligned for activation by the firing pin, wall means abutting the rotor means and including means defining an ignition passage through the wall means, means operatively connecting the rotor means with the inertial mass means for rotation of the rotor means with the rotational movement of the inertial mass means, and means mounting the rotor means for rotation between a first position in which the ignition port is out of communication with the ignition passage when the inertial mass means is in the safe position, and a second position in which the ignition port communicates with the ignition passage when the inertial mass means is in the armed position.

the weight means including means for releasing the ball member from the aperture in the guide means upon movement of the weight means to the ignition position, thereby enabling the firing pin to stab the primer means to initiate ignition of the illuminant in the compartment in the housing.

* * * * *